US005879595A

United States Patent [19]

Holtzman

[11] Patent Number: 5,879,595

[45] Date of Patent: Mar. 9, 1999

[54] CARBURETOR INTERNAL VENT AND FUEL REGULATION ASSEMBLY

[76] Inventor: Barry L Holtzman, 3907 Evergreen Rd., Eagle River, Wis. 54521

[21] Appl. No.: 846,815

[22] Filed: Apr. 30, 1997

Related U.S. Application Data

[63] Continuation-in-part of Ser. No. 821,669, Mar. 19, 1997, abandoned.

[51] Int. Cl.[6] ..... F02M 7/12

[52] U.S. Cl. ..... 261/69.1; 261/69.2; 261/72.1; 261/DIG. 67; 261/DIG. 68

[58] Field of Search ..... 261/69.1, 69.2, 261/70, 72.1, 23.2, DIG. 68, DIG. 67

[56] References Cited

U.S. PATENT DOCUMENTS

| | | | |
|---|---|---|---|
| 1,740,917 | 12/1929 | Beck | 261/72.1 |
| 1,785,681 | 12/1930 | Goudard | 261/41.5 |
| 1,799,585 | 4/1931 | Ensign | 261/72.1 |
| 1,805,763 | 5/1931 | Ensign | 261/72.1 |
| 1,851,711 | 3/1932 | Linga | 261/72.1 |
| 3,210,055 | 10/1965 | Kingsley | 261/69.1 X |
| 3,220,709 | 11/1965 | Pickron et al. | 261/69.1 X |
| 3,235,237 | 2/1966 | Goetz et al. | 261/69.1 X |
| 3,278,171 | 10/1966 | Carlson | 261/69.1 X |
| 3,278,173 | 10/1966 | Cook et al. | 261/69.1 X |
| 3,346,243 | 10/1967 | Walker | 261/69.1 X |
| 3,539,157 | 11/1970 | Fort | 261/69.1 X |
| 3,679,186 | 7/1972 | Hideg | 261/69.1 X |
| 3,730,157 | 5/1973 | Gerhold | 261/DIG. 67 |
| 3,789,812 | 2/1974 | Berry et al. | 261/DIG. 67 |
| 3,800,766 | 4/1974 | Schubeck | 261/69.1 X |
| 3,814,392 | 6/1974 | Boyd et al. | 261/DIG. 67 |
| 3,903,214 | 9/1975 | Sigwald | 261/69.1 X |
| 3,968,189 | 7/1976 | Bier | 261/DIG. 56 |
| 4,323,522 | 4/1982 | Rasmussen | 261/DIG. 8 |
| 4,340,549 | 7/1982 | McKim | 261/69.1 X |
| 4,353,848 | 10/1982 | Carsten | 261/69.1 |
| 4,376,738 | 3/1983 | Reinmuth | 261/63 |
| 4,574,755 | 3/1986 | Sato et al. | 123/320 |
| 4,660,525 | 4/1987 | Mesman | 123/525 |
| 4,728,467 | 3/1988 | Nakagawa et al. | 261/72.1 |

*Primary Examiner*—Richard L. Chiesa

[57] ABSTRACT

An internal vent system contains a pressure sensing orifice located in a carburetor main bore or an auxiliary bore. In one embodiment, this orifice is moved thereby sensing different combinations of total and static pressure of the moving gas stream in which it is located. In another embodiment, the orifice is fixed with a moveable restrictor which changes the gas flow velocity across the orifice and thus changes the pressure sensed by the orifice. The pressure in this orifice establishes the average reference pressure for a float bowl carburetor or a wet diaphragm carburetor, and hence establishes the fuel flow through the carburetor. This adjustable vent is effective in changing fuel delivery over a wide range of engine operating conditions, and is able to minimize the need for changing high speed jets or mid-range calibrations due to changing atmospheric conditions or other operating parameters. The vent movement can be manual or automatic. One such vent of this invention can be used to vent and regulate multiple carburetors, providing lower cost and easier installation and adjustment. This vent is easily adaptable to existing conventional carburetors.

17 Claims, 6 Drawing Sheets

CARBURETOR INTERNAL VENT AND FUEL REGULATION ASSEMBLY

This is a Continuation-In-Part of Application No. 08/821,669, filed 1997 Mar. 19 and now abandoned by Barry L. Holtzman.

BACKGROUND

1. Field of Invention

This invention relates generally to a fuel regulating assembly used in carburetors for internal combustion engines, using a moveable member to affect a change in pressure in an internal vent system.

2. Description of Prior Art

Carburetors operate using air pressure differences acting to force a fuel into a bore of the carburetor, and hence to an engine. This fuel flow is through one or more metering orifices. Modern carburetors use multiple systems or circuits to provide the proper fuel/air ratio required for all engine operating parameters. These systems provide a balance between economy and power, enabling maximum power to be delivered by the engine upon demand, but maximum economy whenever possible.

Two basic elements determine the fuel flow in any of these various circuits. The first element is the physical size of the fuel metering orifice, and to a lesser extent, connecting passageways which comprise the particular fuel circuit. The metering orifice is usually sized to be considerably smaller than the other parts of the fuel delivery system, and for the purpose of analyzing fuel delivery, it can be assumed that the metering orifice constitutes the entire fuel delivery system. The second element is the pressure difference existing across the fuel delivery system, or essentially, the pressure existing across the metering orifice.

The pressure difference acting across the fuel metering orifice in its most basic configuration consists of the pressure existing on the fuel in the fuel chamber of the carburetor, less the pressure existing in the carburetor bore where the outlet of the fuel delivery system is located, less the head pressure of the fuel. The pressure existing on the fuel in the fuel chamber is controlled by an average reference pressure established by a vent. If the vent is entirely external to the carburetor and its air induction passage, the venting is called external, and atmospheric pressure is the average reference pressure used for the carburetor. If the vent communicates with a region of the bore or other area of the air induction passage, for instance the air cleaner, this venting is called internal. In this case, the average reference pressure used for the carburetor will be slightly less than atmospheric, depending on the location of the pressure sensing end of the vent. Both types of venting, internal and external, are well known in the art.

The pressure existing in the carburetor bore and other parts of the air induction system, and hence existing at the outlet of the fuel delivery system, is determined by engine operating conditions, the position of a throttle valve, a variable venturi if so equipped, and the shape and cross sectional area of the carburetor bore. As a gas, or in this case air, is moving at a velocity, the pressure measured by a pressure sensing orifice with its surface parallel to this flow will be lower in regions where the velocity is greater. This is called the Bernoulli effect. Therefore, as engine speed is increased and the carburetor throttle is opened, air velocity in the bore increases, and pressures perpendicular to the wall of the bore decrease. Also, the bore is normally shaped so that there is a region having a decreasing cross sectional area, called a converging section. The portion having the smallest cross sectional area is called the throat, and air speed will be highest in this region. The converging section and throat comprise the venturi; most carburetors have a venturi with fixed dimensions, but some carburetors have a venturi with operably variable dimensions. It is in the throat that a high speed fuel delivery orifice is usually located. The surface of this fuel delivery orifice is usually parallel to the air flow, or in other words perpendicular to a radius of the bore. Locating the fuel delivery orifice in the throat perpendicular to a bore radius gives the maximum fuel flow possible for a given orifice, bore design, and engine operating condition.

The fuel head pressure is simply the pressure required to raise the fuel against gravity a height equivalent to the difference between the level of the fuel delivery orifice in the bore and the level of the fuel in the fuel chamber. It is important that this level be controlled for uniform operation of the carburetor.

Many circuits, bleed systems, accelerator pumps, and other contrivances have been developed over years of carburetor use which modify to some extent this basic operating principle to shape the fuel delivery flow curve as a function of engine operating conditions, but in all carburetors this is the basic underlying operation. As can be seen by the above discussion, to assure the desired operation of the carburetor, the level of fuel in the carburetor, the pressure on the fuel, the size of the fuel metering orifices, and the size and shape of the bore, must be designed in accordance with overall operating parameters.

There are two basic types of carburetors, float bowl carburetors and wet diaphragm carburetors. In a typical float bowl type carburetor, fuel flows from a larger fuel tank into the float bowl of the carburetor, the level of fuel in the float bowl being determined by a float-actuated valve. This system is well known in the prior art and is discussed in my co-pending application number 08/664,187 filed on Jun. 14, 1996 now U.S. Pat. No. 5,772,928. This fuel level, as discussed above, is important in determining overall carburetor performance. In this case, the venting system used, whether internal, external, or a combination of both, determines the pressure existing in the air occupying the space above the fuel internal to the carburetor. This pressure may contain pressure pulses due to fuel inlet valve instability or due to pressure pulses in the carburetor bore, but the average of this pressure is one parameter which determines average carburetor fuel delivery.

In a typical wet diaphragm type carburetor, fuel flows under pressure from the larger fuel tank to the carburetor, and the pressure internal to the carburetor is controlled by a diaphragm-operated valve. This is also discussed in Ser. No. 08/664,187. In this case, there is no fuel level specifically, as there is no void internal to the carburetor; it is completely filled with fuel. In this type carburetor, the dry side of the diaphragm, or the side of the diaphragm opposite the side in contact with the fuel, is housed in a chamber which is either internally or externally vented. The average pressure of this chamber, while not being the actual pressure existing on the fuel internal to the carburetor, is the average reference pressure which determines the fuel pressure internal to the carburetor. This average reference pressure exists on the dry side of the diaphragm, while the fuel pressure internal to the carburetor exists on the wet side of the diaphragm. The movement of this diaphragm positions the moveable member of an inlet valve, and hence regulates the average fuel pressure in the carburetor and therefore helps determine average carburetor fuel delivery.

Internal venting can cause unwanted increases in fuel delivery at certain engine speeds. This is believed to be caused by pressure pulsations in the inlet manifold to the carburetor as discussed in U.S. Pat. Nos. 3,814,392 to Boyd et al (1974), and 5,273,008 to Ditter (1993). U.S. Pat. No. 3,814,392 to Boyd discusses the use of a winding maze in the internal vent passage. This winding maze is claimed to reduce the erratic nature of fuel flow at a critical engine speed. U.S. Pat. No. 5,273,008 to Ditter discusses the use of a primary internal vent with a small external vent to bleed off some of the vacuum. This is claimed to improve the fuel flow consistency by effectively "decoupling" or isolating the carburetor reference pressure from the induction tract pressure pulsations.

Internal venting is also claimed to be a cure for erratic fuel delivery caused by pressure pulsations in the carburetor bore by closely coupling the carburetor reference pressure to these bore pressure pulsations. U.S. Pat. No. 5,133,905 to Woody et al (1992) describes how a fixed Pitot tube (defined as a pressure sensing tube with an open end facing directly into a moving stream of gas) can be used in an internal vent system to reduce pulsations in the fuel delivery by balancing an instantaneous change in reference pressure against the bore pulsation. It is even described how a fixed predetermined spatial relationship between the location of the Pitot tube and the outlet of the fuel delivery system can be used to modify the phase relationship of the carburetor reference pressure to the bore pressure waves at the location of the fuel outlet. The bore pressure sensing device is always described as a Pitot tube, hence this device is a total pressure sensing device. As such, it essentially has no ability to change the magnitude of the average carburetor reference pressure with subsequent modification of average fuel flow. Also, the invention has no adjustment mechanism which could be used to tune the carburetor for changes in atmospheric conditions or engine operating parameters.

Prior art has discussed the use of internal vents to regulate the flow of fuel to an engine. U.S. Pat. Nos. 1,799,585 to Ensign (1931), 1,785,681 to Goudard (1926), 1,740,917 to Beck (1926), and U.S. Pat. No. 1,851,711 to Linga (1932) use an internal vent orifice in the carburetor bore which has its pressure affected by the throttle position. All of these devices are complex and add considerably to the cost of machining the carburetor. Except for U.S. Pat. No. 1,740,917 to Beck, they are not externally adjustable, and consequently are not usable to change fuel flow necessitated by a change in atmospheric conditions, for instance. They only change the shape of the fuel flow versus engine demand curve, and for any fixed set of operating conditions, the fuel flow is determined and not adjustable. U.S. Pat. No. 1,740,917 to Beck uses an internal vent positioned adjacent the throttle, and uses an adjustable (throttled) external vent to provide an external adjustment of the fuel flow.

Changes in atmospheric conditions, such as temperature, relative humidity, barometric pressure, and elevation, all of which determine the relative air density, have a considerable affect on the fuel delivery requirements of the engine. Changes in relative air density, without a corresponding change in carburetor tuning, result in engine loss of power or a waste of fuel. For instance, a snowmobile engine, which has carburetors tuned or jetted for proper operation at −20 degree Fahrenheit, will run overly rich and get the "blubbers" when run at +40 degrees Fahrenheit, unless the carburetor has the main jets changed to lean the mixture. In extreme cases, the mid-range operation of the carburetor must also be modified by moving or replacing a needle which affects the effective size of the fuel delivery orifice at part-throttle positions. The main jets, of necessity, are located near the bottom of the float bowl, and the changing of these jets is time consuming and results in loss of fuel. Repositioning or changing the mid-range needles is also time consuming and requires partial disassembly of the carburetor. Some carburetors have external mixture screws which adjust an opening in a fuel feed port which parallels the main jet. These systems are expensive to manufacture, and each carburetor must have its own adjustment system. Also these systems work by changing the effective size of the fuel delivery orifice, and not by changing the pressure acting to move the fuel through the fuel delivery system.

U.S. Pat. No. 5,021,198 to Bostelman (1990) describes a carburetor altitude compensation system using a combination of vents to regulate the fuel flow through the carburetors. In this system, an aneroid bellows is used to position a valve (choke), which changes the relative pressure effect of two orifices. One orifice is in the venturi region of the carburetor bore, and hence provides a vacuum to the float bowl which tends to decrease the flow of fuel. The other orifice is connected to a region of essentially atmospheric pressure, for instance the air cleaner, and tends to establish the float bowl pressure at atmospheric pressure, at which maximum fuel flow will occur. The valve is located in the high (atmospheric) pressure vent line and it "throttles" the flow of air through the high pressure line. As the valve moves toward the closed position, the increased throttling reduces the effect of the high pressure line relative to the low pressure line, lowering the pressure in the vent system. The consequent reduction in float bowl pressure results in a reduction of fuel flow through the carburetor. This system, like the adjustment in U.S. Pat. No. 1,740,917 to Beck, establishes a pressure by balancing two series orifices, one orifice being variably throttled. This is a tricky business considering the low pressure differentials existing in the carburetor system. Also, a throttling operation, such as used in these systems, is thermodynamically different than the essentially isentropic gas flow existing in a venturi. It is desirable to change fuel flow as uniformly as possible over the largest range of engine operating conditions. This uniformity is more readily accomplished using similar thermodynamic principles in the fuel delivery system and in the regulating system. Systems operating on a similar principle using valves and thermodynamic throttling are described in U.S. Pat. Nos. 4,660,525 to Mesman (1987), 4,574,755 to Sato et al (1986), 4,376,738 to Reinmuth (1983), 3,968,189 to Bier (1976), 3,789,812 to Berry et al (1974), and 3,730,157 to Gerhold (1973). All of these systems use a valve of some nature, usually of a needle type or a sliding type, which is usually operably closed to create an effective valve opening small compared to the area of the conduits to which it is attached, and perform a throttling operation to reduce the total pressure after passing the valve.

It is important to note that the fuel regulation systems using a valve in conjunction with a fixed orifice, or a valve in conjunction with another valve, use the throttling effect of the valve(s) to establish an intermediate pressure between two different pressure sources. A throttling operation is thermodynamically defined as an operation in which entropy is not constant; a throttling operation is not isentropic. Another property of a throttling operation is that total pressure is not constant, but is lower after the throttling has occurred. This reduction in total pressure is then used to modify the average reference pressure of the carburetor, and hence modify fuel flow.

Carburetors also have various components such as the above mentioned needles moving with the throttle valve to change the effective size of the fuel delivery orifice, pilot circuits to provide a transition from the low speed circuit to the high speed circuit, accelerator pumps to provide additional fuel during rapid acceleration, power jet circuits to provide additional fuel under full power operation, and variable venturis. All of these components and systems provide shaping of the fuel delivery as a function of engine operating conditions. These systems again are expensive to manufacture, and in many cases, are not externally adjustable, but require carburetor disassembly for their adjustment.

OBJECTS AND ADVANTAGES

Among the several objects of the present invention is to provide an adjustable internal carburetor vent using essentially isentropic gas flow to provide an improved uniformity in fuel flow modification for all throttle positions and engine operating conditions.

It is a further object of this invention to provide an adjustable internal carburetor vent which uses no throttling valves in its operation.

It is a further object of this invention to provide an internal vent which provides fuel flow modification by changing the carburetor average reference pressure by using the Bernoulli effect to effect this change.

It is a further object of this invention to provide an adjustable internal vent for a carburetor which can easily have its low pressure sensing orifice located axially close to the main fuel delivery port with a minimum of manufacturing expense.

Another object of the present invention is to provide an easy, external provision for changing the carburetor fuel delivery in response to changes in relative air density or engine requirements. This adjustment capability will reduce the need for jet changes or fuel delivery adjustment screws, while providing this function at a lower manufactured cost and considerable savings of time to the user of the carburetor.

Another object of the present invention is to provide an internal vent for a carburetor which can either effectively isolate the carburetor reference pressure from pressure fluctuations in the carburetor bore, or effectively couple the carburetor reference pressure to these pressure fluctuations.

In addition, an object of the present invention is to provide an internal vent fuel regulating system which can easily and inexpensively convert a carburetor manufactured with an external vent system and conventional fuel regulation requiring changing fuel delivery components to a carburetor with an internal vent capable of performing this fuel regulation function.

It is a further object of this invention to provide an internal vent which can be employed to vent and regulate more than one carburetor in a multi-carbureted engine.

It is a further object of this invention to provide an adjustable internal vent for a wet diaphragm carburetor or a float bowl carburetor.

Still further objects and advantages will become apparent from a consideration of the ensuing description and drawings.

DRAWING FIGURES

Reference Numerals In Drawings

Figure 1:
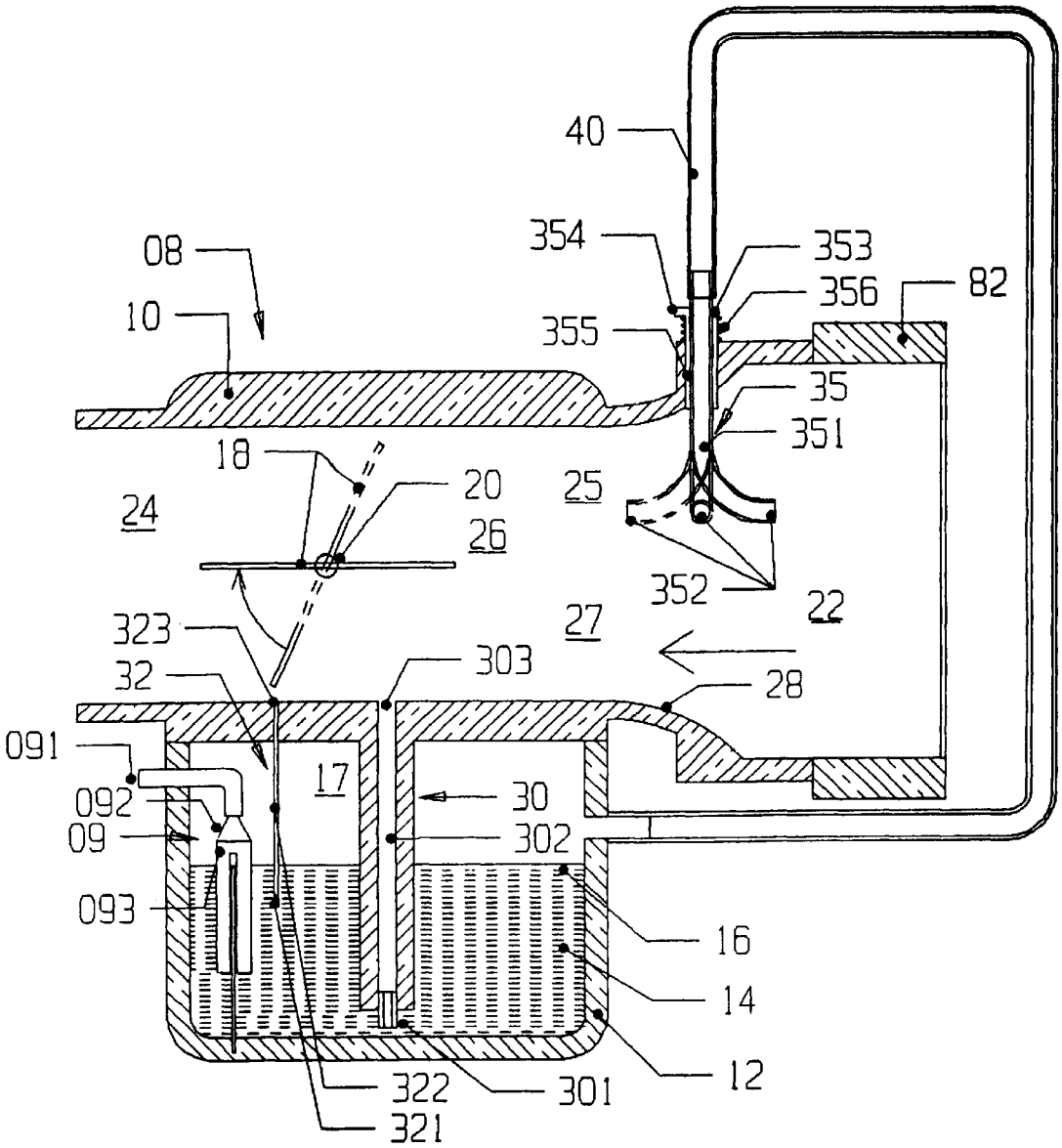
FIG. 1 shows a cross sectional view from the side of a float bowl carburetor taken in a plane coinciding with the axis of the carburetor bore, having a moveable orifice internal vent in the main bore.

08 float bowl carburetor assembly
08' wet diaphragm carburetor assembly
08" multiple float bowl carburetor assembly
09 fuel inlet assembly
091 fuel inlet conduit
092 fuel inlet valve
093 fuel inlet float control mechanism
10 float bowl carburetor body
11 wet diaphragm carburetor body
12 float bowl
13 wet diaphragm fuel chamber
14 fuel
16 fuel level
17 float bowl air volume
18 butterfly throttle valve
20 throttle valve pivot shaft
22 air inlet or bell
24 air/fuel outlet
25 main bore venturi
26 throat
27 main bore
27' auxiliary bore
28 converging section
30 high speed fuel delivery system
301 high speed jet
302 high speed fuel delivery conduit
303 high speed fuel outlet orifice
32 low speed fuel delivery system
321 low speed jet
322 low speed fuel delivery conduit
323 low speed fuel outlet orifice
35 main bore moveable orifice internal vent assembly
351 conduit
352 main bore pressure sensing orifice
353 engagement member
354 pivot arm and pressure sensing orifice position indicator
355 engagement threads
356 anti-rotation spring
36 auxiliary bore moveable orifice internal vent assembly
361 conduit
362 auxiliary bore pressure sensing orifice
363 engagement member
366 anti-rotation spring
368 adjuster body
36' auxiliary bore moveable orifice internal vent assembly preferred embodiment

361' preferred embodiment conduit
362' preferred embodiment pressure sensing orifice
363' preferred embodiment engagement member
364' snap ring
366' "o" ring
368' preferred embodiment adjuster body
37 auxiliary bore fixed orifice/moveable restrictor internal vent assembly
371 fixed orifice connecting conduit
372 fixed pressure sensing orifice
377 auxiliary bore restrictor
378 fixed orifice/moveable restrictor body
40 vent/air chamber connecting conduit
48 main bore low pressure sensing orifice
49 low pressure connecting conduit
50 high pressure sensing orifice
52 high pressure connecting conduit
53 moveable orifice adjuster body cavity
53' fixed orifice/moveable restrictor body cavity
54 secondary vent/air chamber connecting conduit
56 carburetor interconnecting vent conduits
62 wet diaphragm fuel inlet assembly
621 wet diaphragm fuel inlet conduit
622 wet diaphragm fuel inlet valve
623 lever arm
624 spring
625 pivot pin
64 diaphragm
66 diaphragm wet chamber
68 diaphragm air chamber
82 air filter
90 aneroid bellows
92 platform
94 connecting member Description-FIG. 1

FIG. 1 shows a carburetor assembly 08 with an internal vent moveable orifice assembly 35 in main bore 27 in accordance with this invention. Carburetor body 10 is usually cast and then machined to provide all the drillings, tapped holes, and smoothing required for its proper operation. A float bowl 12 is attached to body 10 usually with screws and a sealing gasket, not shown. Fuel entry into the carburetor is controlled by a fuel inlet assembly 09, consisting of a fuel inlet conduit 091, fuel inlet valve 092, and fuel inlet float control mechanism 093. Fuel 14 is allowed to enter carburetor until predetermined fuel level 16 is attained. The total volume of air in the carburetor is contained in the float bowl air volume 17, simply the carburetor internal volume less the volume of fuel. A butterfly throttle valve 18 pivots on shaft 20 and is controlled by an accelerator linkage, not shown. Air enters the carburetor through air filter 82, entering at air inlet or bell 22; a mixture of air and fuel exit at outlet 24. The entire drilling from bell 22 to outlet 24 is main bore 27. The part of main bore 27 having the smallest cross sectional area is throat 26, and the section where bell 22 decreases in cross sectional area to the cross sectional area of throat 26 is called converging section 28. Throat 26 and converging section 28 comprise venturi 25. The venturi 25 is shown as being fixed in body 10, and is the most common construction. Some carburetors use a variable main bore venturi (not shown) which changes the effective throat size to affect carburetor fuel flow characteristics. A high speed fuel delivery system 30 consists of high speed jet 301, high speed fuel delivery conduit 302, and high speed fuel outlet 303. Low speed fuel delivery system 32 consists of low speed jet 321, low speed fuel delivery conduit 322, and low speed fuel outlet 323.

An adjustable vent assembly 35 uses a rotatable conduit 351 with a pressure sensing orifice 352. Moveable assembly 35 has an engagement member 353 with engagement threads 355 and which may have a pivot arm 354 with markings on its external surface, not shown, to indicate the position of sensing orifice 352. Anti-rotation force is provided for assembly 35 by spring 356. Pressure sensing orifice 352 is connected to air volume 17 with conduit 40.

Operation-FIG. 1

Several thermodynamic aspects of compressible fluid dynamics are used and presented in this application. A good reference for some of the thermodynamic material presented here is "Mechanical Engineering Reference Manual" by Michael R. Lindeburg, P.E., especially Chapters 6 and 8.

One aspect of compressible gas flow dynamics which is basic to the understanding of this invention concerns the gas pressure existing in a steadily moving stream of gas. Total pressure, sometimes called stagnation pressure, is the pressure which would be measured in a gas stream with a pressure sensing orifice, such as 352, facing directly toward the incoming stream of gas, commonly called a Pitot tube. In other words, orifice 352 measures total pressure of the air stream when orifice 352 faces toward the right in FIG. 1. Another way of saying this is that orifice 352 measures total pressure when the plane, or surface, of orifice 352 is perpendicular to the flow. The total pressure is essentially constant whether measured in bell 22, along converging section 28, and even in throat 26 before throttle 18. The air flow in the areas of constant total pressure is isentropic. This total pressure is the pressure which exists before bell 22, namely the pressure in the air cleaner if so equipped, or the ambient pressure around the carburetor in the absence of an air cleaner, and is essentially atmospheric. At small openings of throttle 18, total pressure drops across throttle 18, and the flow past throttle 18 is "throttled" thermodynamically speaking, in other words is not isentropic. As throttle 18 is progressively opened, total pressure in region 24 approaches the total pressure existing before throttle 18, and the gas flow throughout bore 27 becomes essentially isentropic, including the location of high speed fuel discharge orifice 303.

Static pressure, or the pressure measured by a pressure sensing orifice with its surface parallel to the direction of gas flow, is not constant, however. As gas velocity increases, static pressure decreases, and is commonly called the Bernoulli effect. Orifice 352 senses static pressure when in the center position in FIG. 1, with the end facing the reader. Static pressure is not constant along bore 27, but will be highest in the area of greatest cross sectional area, in bell 22 for instance. It will be lowest in the area of smallest cross sectional area, throat 26 for instance. Static pressure in bell 22 is slightly less than atmospheric, and decreases through converging section 28 to a minimum value in throat 26. If throttle 18 is partially closed, this in effect decreases the free area in throat 26, decreasing the static pressure in this region below a value which would be present in the absence of throttle 18.

If the gas is stationary, the static pressure and the total pressure are equal, and then are atmospheric in this case.

The relationship between static pressure and total pressure for air is given by the following formula:

$$p_Y/p=(0.2*M^2+1)^{3.5}$$

where $p_Y$=total pressure p=static pressure

M=speed of gas/speed of sound in medium

If the gas flow is steady, the mass flow is constant across any section of the flow path at any instant of time. Therefore, the speed of the flow must be greater in areas of smaller cross sectional area, and less in areas of greater cross sectional area. Considering the formula for static pressure as a fraction of total pressure given above, it is obvious that the static pressure will be less in areas of higher gas velocity, or in areas of smaller cross sectional area. Conversely, static pressure will be higher in areas of larger cross sectional area.

It is of course the difference between total pressure and static presure which is the underlying principle upon which a carburetor works. For instance if the carburetor is externally vented, total, or in this case atmospheric, pressure exists in fuel chamber volume 17. Fuel discharge outlets 303 and 323, because they are perpendicular to bore 27, sense the static pressure present in bore 27 at their location, which is lower than total pressure when the engine is running. Therefore, there is a pressure differential which causes fuel to be forced up through jets 301 and 321, mixing with air in main bore 27. This mixture passes through air/fuel outlet 24 and on to engine.

Moveable assembly 35 is shown in this case as having a part which may be rotated. A threaded hole is provided in carburetor body 10, into which engagement member 353 may be screwed. Spring 356 prevents unwanted rotation of assembly 35. As assembly 35 is rotated, the pressure existing in chamber 17 is changed. Specifically, when the plane of orifice 352 is perpendicular to the flow, the pressure seen by orifice 352 is total pressure, which is the maximum which it can see. Hence, the pressure in chamber 17 is a maximum, and hence fuel flow is a maximum. As assembly 35 is rotated positioning the plane of orifice 352 parallel to the flow, the pressure in end 352 is reduced to the static pressure in that portion of bore 27 in which it is located. As a consequence of this rotation, pressure in chamber 17 is reduced to the static pressure existing in the particular part of bore 27 in which orifice 352 is located. This pressure is lower than total pressure, and therefore the pressure difference forcing the fuel through jets 301 and 321 is reduced. As a result of this pressure reduction, fuel flow is decreased. Further rotation of orifice 352 to a position in which the orifice faces downstream of the flow would result in a continued sensing of essentially static pressure with essentially no further reduction in fuel flow. It is seen from this discussion that a rotation of internal vent assembly 35 will change fuel flow, this flow continuously decreasing as rotation progresses from a maximum at the total pressure position to a minimum where the surface of orifice 352 is sensing only static pressure.

Of course, other ways can be conceived to perform the function of lowering the pressure in chamber 17 which would fall under the principle of this invention. For instance, orifice 352 could be fixed somewhere between the static pressure position and the total pressure position, then operably moved along converging section 28. This would also perform the function of changing fuel delivery since the static pressure is changing along converging section 28, and would effect a change in chamber 17 pressure.

I have shown the rotation of assembly 35 to be a manual adjustment. This rotation, or any other movement such as the linear movement discussed above, could be performed automatically in response to atmospheric conditions such as temperature, barometric pressure, relative air density, or elevation. For instance, a sealed bellows which moves in response to changes in atmospheric pressure could be employed to move or rotate assembly 35 automatically. Other methods for relative air density compensation are well known in the art. Also, other engine operating parameters such as exhaust gas temperature and RPM could be used to perform the movement of assembly 35.

Another important part of this internal vent is the length of conduit 40. It is known that the air flow through carburetor bore 27 is not steady. Air flow through the carburetor is interrupted while the intake port of the engine is closed, and allowed to flow only when the intake port is opened. There exist, therefore, pressure pulsations in bore 27 which vary in accordance with engine frequency. It is sometimes advantageous to design the internal carburetor vent in a manner that will isolate chamber 17 from these pressure fluctuations. This is easily accomplished by selecting the proper length and diameter of conduit 40. Lengthening conduit 40 and decreasing its internal diameter will help isolate chamber 17 from pulsations in main bore 27. A flexible plastic tube has been used satisfactorily for conduit 40 have an inside diameter of 3.2 mm (0.125 inches) and a length of 914 mm (36 inches).

The isolation of chamber 17 from pulsations in main bore 27 is not necessary to provide the fuel regulation cabability of a moveble internal vent as described above. The moveable vent can still perform its function as a fuel regulation means even if this isolation is not provided. Some unwanted changes in fuel delivery may occur at certain engine speeds, but in many cases this is acceptable, and the user of this internal vent may elect to make conduit 40 as short as possible for reasons of economy. Conduit 40 could also be made short in order to closely couple the carburetor reference pressure to the pressure fluctuations in bore 27 if this close coupling is desired.

Fuel spillage out of the internal vent shown in FIG. 1 can be minimized by simply positioning conduit 40 as far above fuel level 16 as possible. In other words, since conduit 40 can be located outside carburetor body 10, the size of the carburetor does not determine the angle of inclination at which fuel spillage will occur. Also, the orientation of the carburetor is not important, since conduit 40 can be made of a flexible material, such as plastic or rubber, and hence can be elevated irrespective of carburetor orientation.

Figure 2:
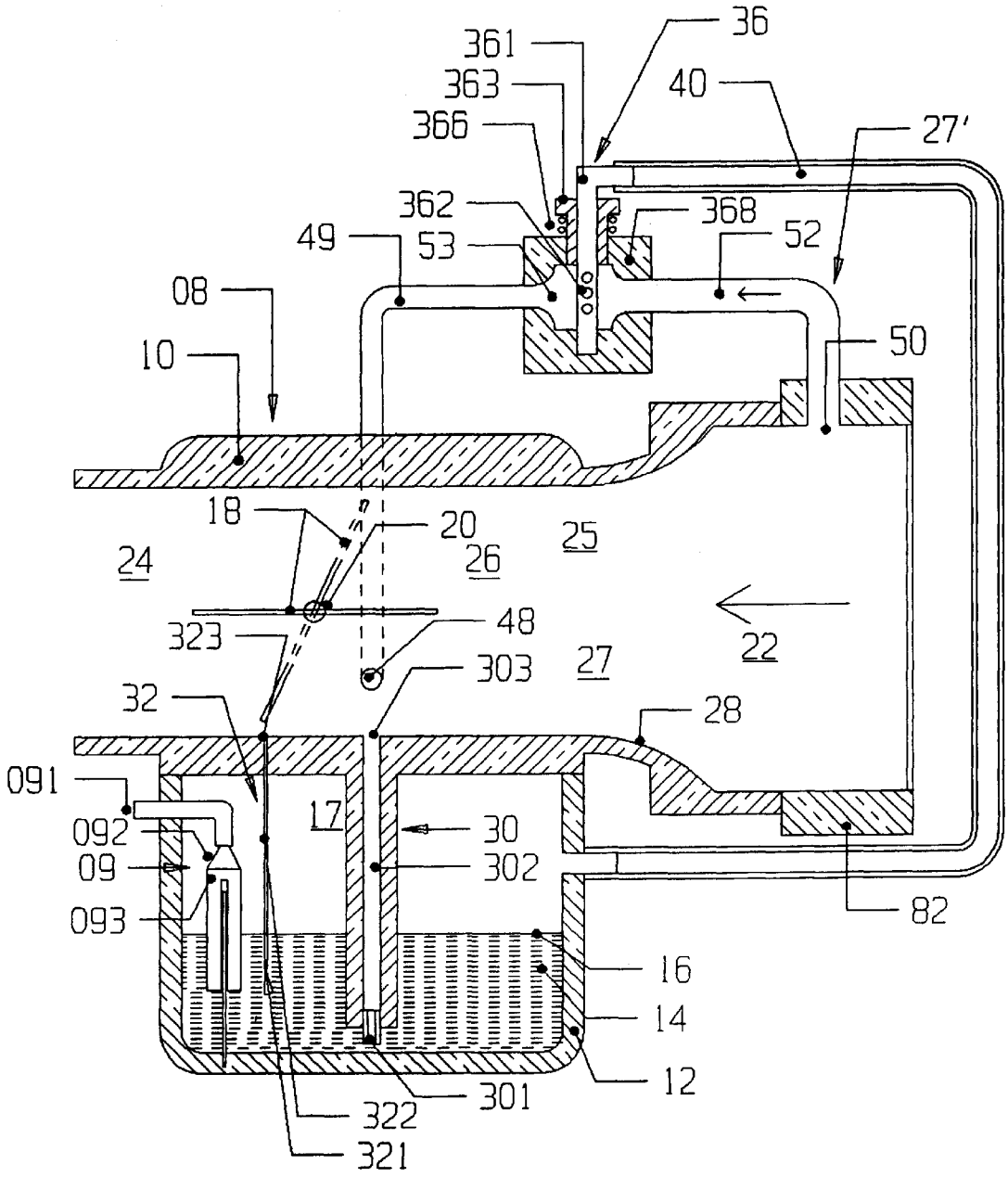
FIG. 2 shows a cross sectional view from the side of a float bowl carburetor taken in a plane coinciding with the axis of the carburetor bore, having a moveable orifice internal vent in an auxiliary bore.

Description and Operation-FIG. 2

FIG. 2 is similar to FIG. 1 except an internal vent moveable orifice assembly 36 has been placed in an auxiliary bore 27'. Auxiliary bore 27' consists of main bore low pressure connecting conduit 49, adjuster body cavity 53, and high pressure connecting conduit 52, with main bore low pressure sensing orifice 48 and main bore high pressure sensing orifice 50. Assembly 36 has pressure sensing conduit 361, pressure sensing orifice 362, engagement member 363, anti-rotation spring 366, and body 368. Auxiliary bore 27' effectively parallels a portion of main bore 27, and both are part of the air induction tract of the carburetor.

Auxiliary bore 27' has gas flow in the direction shown by the arrow. This flow is created due to the fact that orifice 48 is sensing a lower pressure than orifice 50, because end 48 is in a region of bore 27 where gas flow is higher due to throat 26 restriction. Orifice 362 senses the flow and pressure in auxiliary bore 27' rather than directly the flow and pressure in main bore 27. Orifice 362 is shown as simply holes located in the side of conduit 361, and these holes act effectively the same as pressure sensing orifice 352 in assembly 35. In this case the surface of orifice 362 lies in a plane which contains these holes. This construction of orifice 362 in conduit 361 allows a smaller size for body cavity 53 than would be permitted considering the radius required for the bend in conduit 351. Rotation of conduit 361 provides different combinations of static and total pressures in orifice 362, and therefore modifies fuel flow as when using assembly 35 described above. In other words, rotation of conduit 361 changes the angle between the surface of orifice 362 and the direction of gas flow.

This location of the vent pressure sensing orifice 362 in auxiliary bore 27' is advantageous over its location in main bore 27 for several reasons. In most cases, it is desirable to have the internal vent modify fuel delivery as uniformly as possible over the widest range of engine operating conditions. It is therefore beneficial to monitor main bore 27 pressure as closely as possible to the pressure seen by main fuel outlet 303. In the case of the embodiment shown in FIG. 1, this would require conduit 351 to be moved into throat 26 enabling end 352 to lie in a position similar to orifice 48 in FIG. 2. This is difficult to do as a practical matter because of the movement and location of throttle 18. End 48, however, in its simplest form is simply a hole drilled into the side of main bore 27, and as such does not interfere with the operation of throttle 18.

Another advantage of the embodiment employing an auxiliary bore 27' is the ability to easily establish the relative effect and regulation of the rotation of orifice 362. If a small rotation is desired for any effect on fuel flow, the area of cavity 53 in the region of orifice 362 should be made smaller relative to the areas of the other components of auxiliary bore 27' than a design requiring more rotation for the same flow modification. This results from the fact that for any construction of auxiliary bore 27', enlarging the cross sectional area of 53 at orifice 362 will reduce the speed of gas flow in this area. This will result in an increase in static pressure, therefore lessening the effect of orifice 362 on fuel flow for any given rotation. In fact, if the area of 53 is made large enough, this can be used to insure that orifice 362 can be rotated to any position and not allow the engine to experience an overly-lean fuel delivery which can result in engine damage. An embodiment similar to assembly 36 has been manufactured using replaceable sleeves (not shown) to effectively change the cross sectional area of cavity 53, and hence affect the sensitivity of the rotation of orifice 362.

Auxiliary bore 27', conduits 49 and 52, and assembly 36 are shown at least partially lying outside body 10, but in various degrees could be machined into body 10 if sufficient material in the casting of body 10 is available. The external location shown in FIG. 2 is preferred in many instances however. If an existing carburetor is to be modified to use this fuel regulating invention, the only modification to the carburetor required by this external location is to simply provide a hole in body 10 creating pressure sensing end 48 and a receptacle for conduit 49. Also, as discussed later, only one assembly 36 is required to regulate multiple carburetors, and external positioning allows more uniformity in the manufacture of carburetors 08. In other words, all carburetors would not need auxiliary bore 27' and assembly 36, and providing them in all carburetors would be inefficient. Also, there does not appear to be any practical limit to the length of conduit 49, and as such allows great freedom in selecting the location of assembly 36. It could be mounted on the handlebars of a snowmobile, for instance, allowing the driver to tune the sled while in motion.

Orifice 50 is shown as opening into air filter 82, but other locations would work. For instance, orifice 50 could open directly to the atmosphere, with a suitable filter if desired. Orifice 50 could also be located in any region of main bore 27 as long as the pressure in orifice 50 differs from the pressure in orifice 48. Location of orifice 50 in, for instance, converging section 28 would decrease the total pressure in auxiliary bore 27', which is most times undesirable because of the reduction in fuel flow even with orifice 362 in the total pressure position. Both orifices 48 and 50 are shown as reading static pressure only. It may be beneficial in some instances to locate either or both of these orifices so that they read some degree of total pressure, and even could be themselves rotated or moved along bore 27 to provide a "tiered" adjustment assembly. The position of orifice 48 shown in this figure is preferred, but other locations along bore 27 will still provide fuel delivery modification.

It is the total combination of pressures in orifices 48 and 50, and the relative cross sectional area of body cavity 53 compared to the overall dimensions of auxiliary bore 27' which determines the fuel modification caused by a rotation of orifice 362. Various combinations are possible which can affect the fuel delivery modification.

Figure 3:
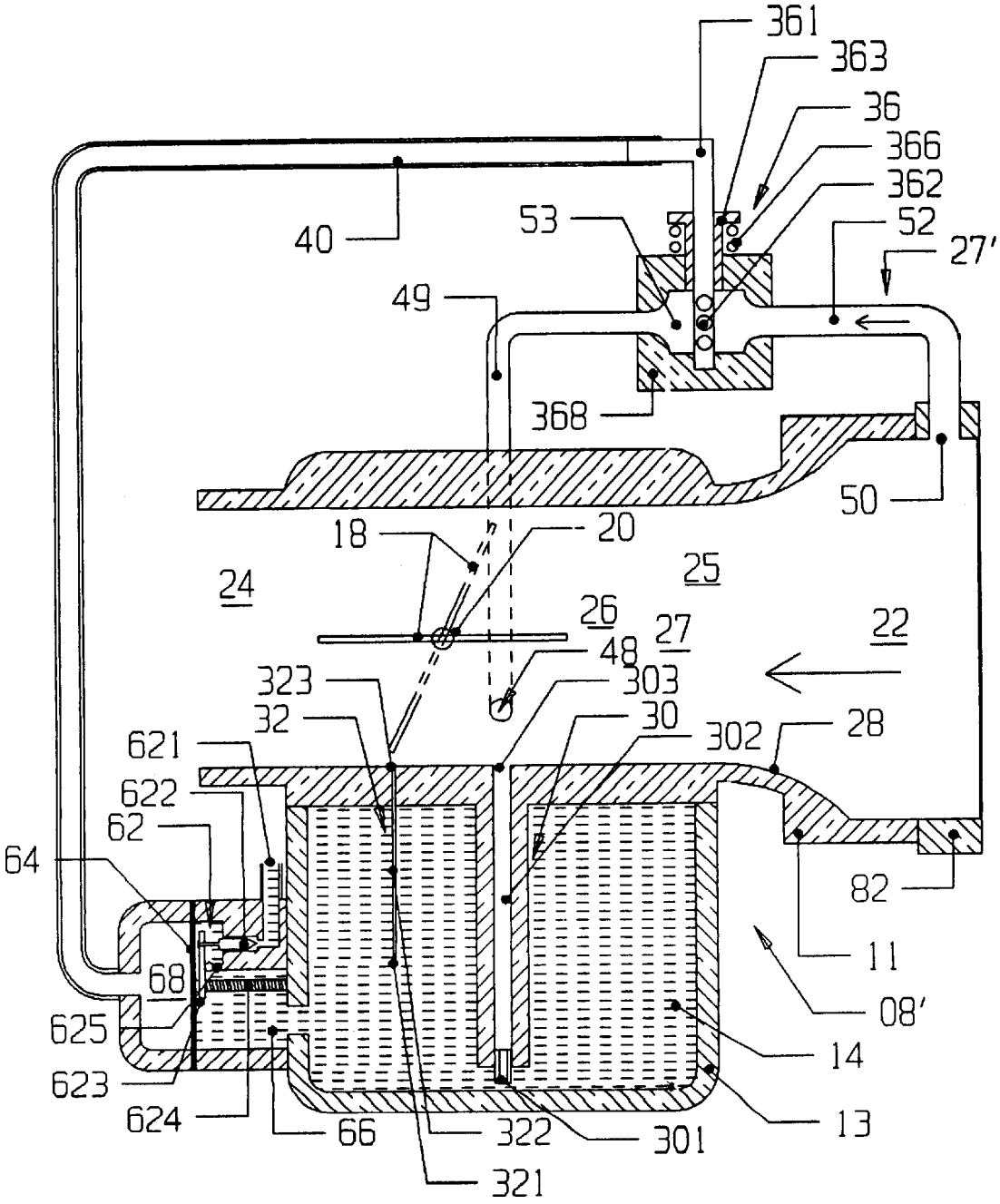
FIG. 3 shows a cross sectional view from the side of a wet diaphragm carburetor taken in a plane coinciding with the axis of the carburetor bore, having a moveable orifice internal vent in an auxiliary bore.

Description and Operation-FIG. 3

FIG. 3 shows the same cross section as FIG. 2 except showing a wet diaphragm carburetor. Operation is essentially the same, except chamber 13 is completely full of fuel under pressure. In fact, the entire carburetor is full of fuel except for diaphragm dry chamber 68. Fuel inlet assembly 62 consists of inlet conduit 621 which delivers fuel from a larger storage tank, not shown. Fuel inflow is controlled by valve 622, being operated by the action of diaphragm 64 on lever arm 623 pivoting on pin 625. Spring 624 in large part determines the level of fuel pressure existing in chamber 13. Diaphragm 64 senses on its dry side the pressure in chamber 68, and senses on its wet side fuel pressure in chambers 66 and 13.

The primary function of fuel inlet assembly 62 is to maintain a constant fuel pressure in chambers 66 and 13 to insure correct fuel delivery of the carburetor. This function is accomplished by the action of diaphragm 64 on valve 622. As fuel 14 is drawn from chamber 13 through jets 301 and 321, pressure in 13 starts to decrease. This decrease in pressure also occurs in chamber 66, and diaphragm 64 moves slightly from the dry side toward the wet side. This increases the opening of valve 622, causing an increased flow of fuel to the carburetor. This increased inflow increases pressure in chambers 66 and 13 which moves valve 622 toward the closed position. In this manner, the fuel pressure internal to the carburetor is maintained in a small range about some equilibrium value for satisfactory operation.

The air pressure in chamber 68 is a factor in determining the pressure existing in fuel chambers 66 and 13. If the air pressure in chamber 68 is decreased, the fuel pressure in chambers 66 and 13 will decrease. Conversely, if the air pressure in chamber 68 is increased, the fuel pressure in chambers 66 and 13 will increase. Fuel flow through the carburetor is determined by the pressure existing in chambers 66 and 13. Auxiliary bore moveable orifice assembly 36 can also be used in this type of carburetor to regulate fuel flow. In the float bowl carburetor, assembly 36 is used to modify the air pressure in chamber 17. In this use with a wet diaphragm carburetor, vent assembly 36 is moved to modify the pressure in chamber 68, which then indirectly modifies the fuel pressure in chambers 66 and 13. A change in fuel delivery is again a result of this fuel pressure change.

Figure 4:
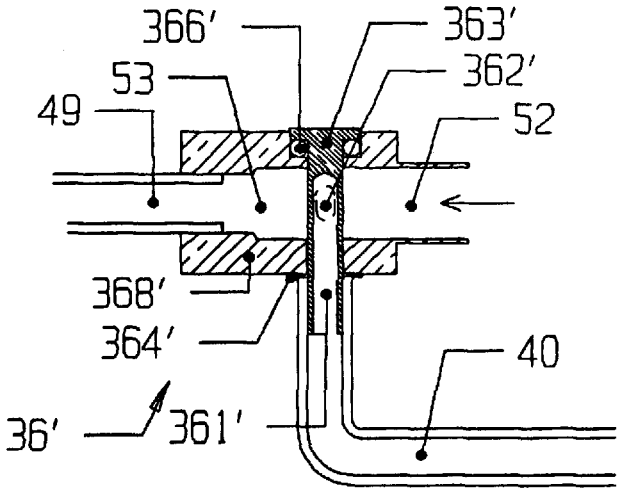
FIG. 4 shows a detail view of a preferred embodiment of a moveable orifice internal vent assembly suitable for use in an auxiliary bore.

Description and Operation-FIG. 4

FIG. 4 shows a preferred embodiment 36' of assembly 36. In this assembly, the anti-rotation function is supplied by a compressed "o" ring 366', and conduit 361' is simply a hole drilled into engagement member 363'. The top of engagement member 363' has a screwdriver slot (not shown) milled into its surface for ease of rotation. Also, the top of body 368' has markings (not shown) which, used in conjunction with the screwdriver slot, indicate position of orifice 362', and hence relative fuel flow. A snap ring 364' is used to compress "o" ring 366' and hold member 363' in body 368' but still allow rotation of 363'. Also, conduit 40 is connected to the bottom of assembly 36' which allows easier access to the screwdriver slot in 363'. Body 368' was machined from aluminum, and member 363' was machined from brass, but other metals, plastics, or other suitable materials could be used effectively. This assembly is compact, able to be contained in a rectangular solid of dimension 12.7 mm(0.5 inches) by 29 mm (1.125 inches) by 51 mm (2 inches).

Figure 5:
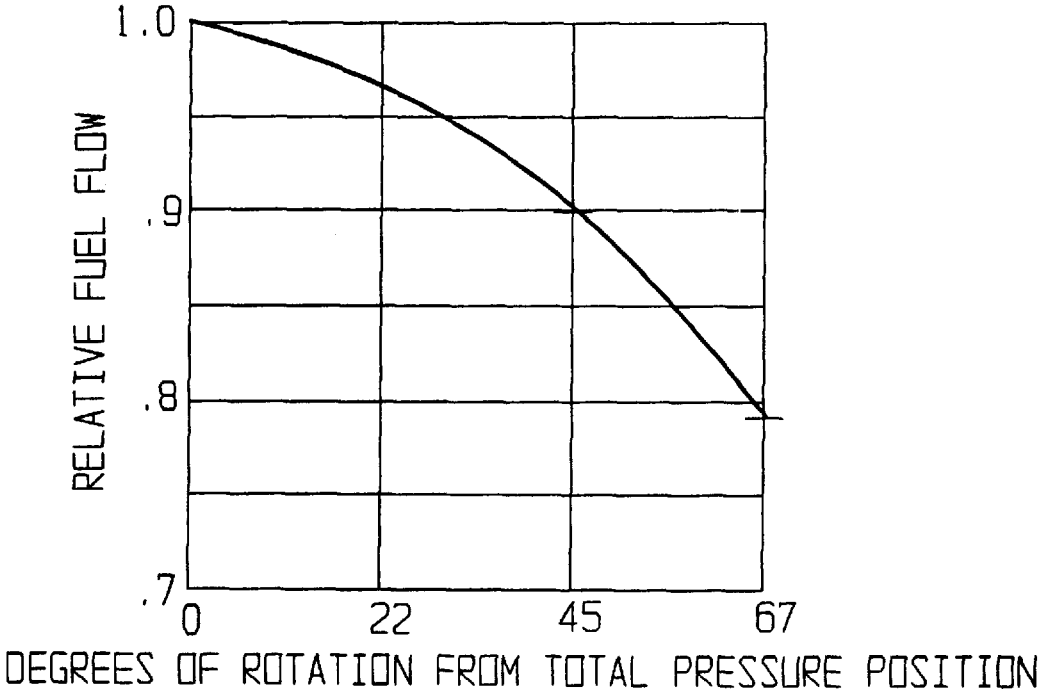
FIG. 5 shows a graph of full load relative fuel flow as a function of a moveable orifice internal vent rotation.

Description-FIG. 5

The following dimensions were used in a prototype assembly similar to 36 and gave the fuel modification curve shown in FIG. 5. Low pressure orifice 48 was positioned approximately as shown in FIG. 2, except the carburetor used had a round slide throttle instead of a butterfly throttle as shown. Instead of the rotation shown for butterfly throttle 18, slide type throttles act to restrict air flow to the engine by simply "sliding" down into bore 27, effectively reducing the area of throat 26. Orifice 48 was located so that the bottom of the slide throttle passed over 48 at about 25% open throttle, but a milling existing in the side of the slide throttle ensured that 48 was always open to bore 27 and not shut off by the slide throttle. In other words, it was an object of this construction to not have the throttle change the effective size of orifice 48. Orifice 48 had a diameter of 6.4 mm (0.25 inches). Cavity 53 had an inside diameter of 8.8 mm (0.345 inches). Conduit 361 had an inside diameter of 3.2 mm (0.125 inches), and orifice 362 was an elongated milled slot 2.4 mm (0.094 inches) wide with a length which yielded an opening area about 25% greater than the area of the drilling through conduit 361. Orifice 50 was open to the atmosphere and was 8.8 mm (0.345 inches) in diameter.

An engine was run on a dynamometer under full load, and fuel flow was measured as a function of rotation of orifice 362. The results are shown in FIG. 5. Fuel flow dropped about 22% with a 67 degree rotation of orifice 362. Dynamometer runs at half open throttle were also performed. Rotation of orifice 362 had an affect on fuel flow even at this low engine load level, and significant changes in half-throttle horsepower were observed.

Figure 6:
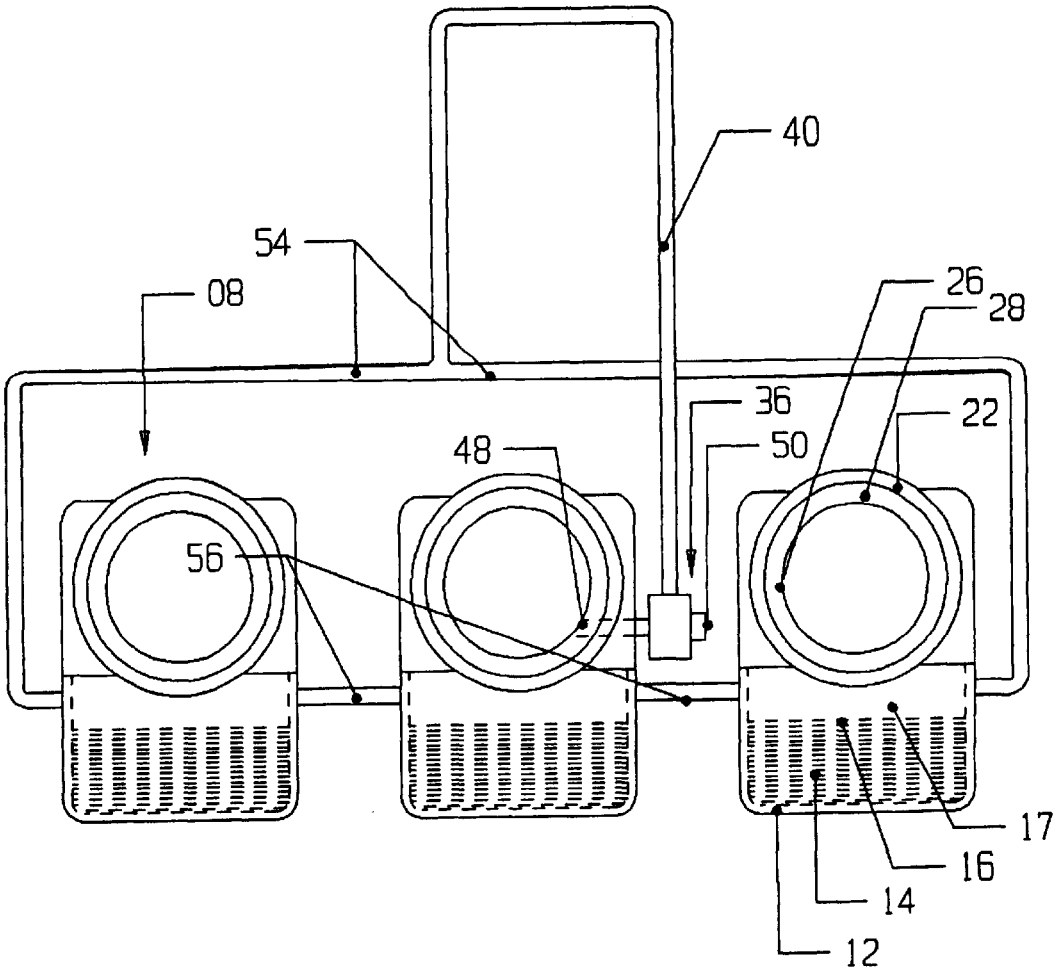
FIG. 6 shows an internal vent fuel regulating assembly connected to more than one carburetor assembly.

Description and Operation-FIG. 6

FIG. 6 shows one assembly 36 regulating fuel flow through three carburetors 08. Conduit 40 splits into two secondary conduits 54, each one of these connected to a carburetor. The third carburetor is then connected to the first two using interconnecting conduits 56. Other methods work using other connections and number of carburetors providing all volumes 17 in all carburetors are effectively connected to each other and to assembly 36.

Figure 7:
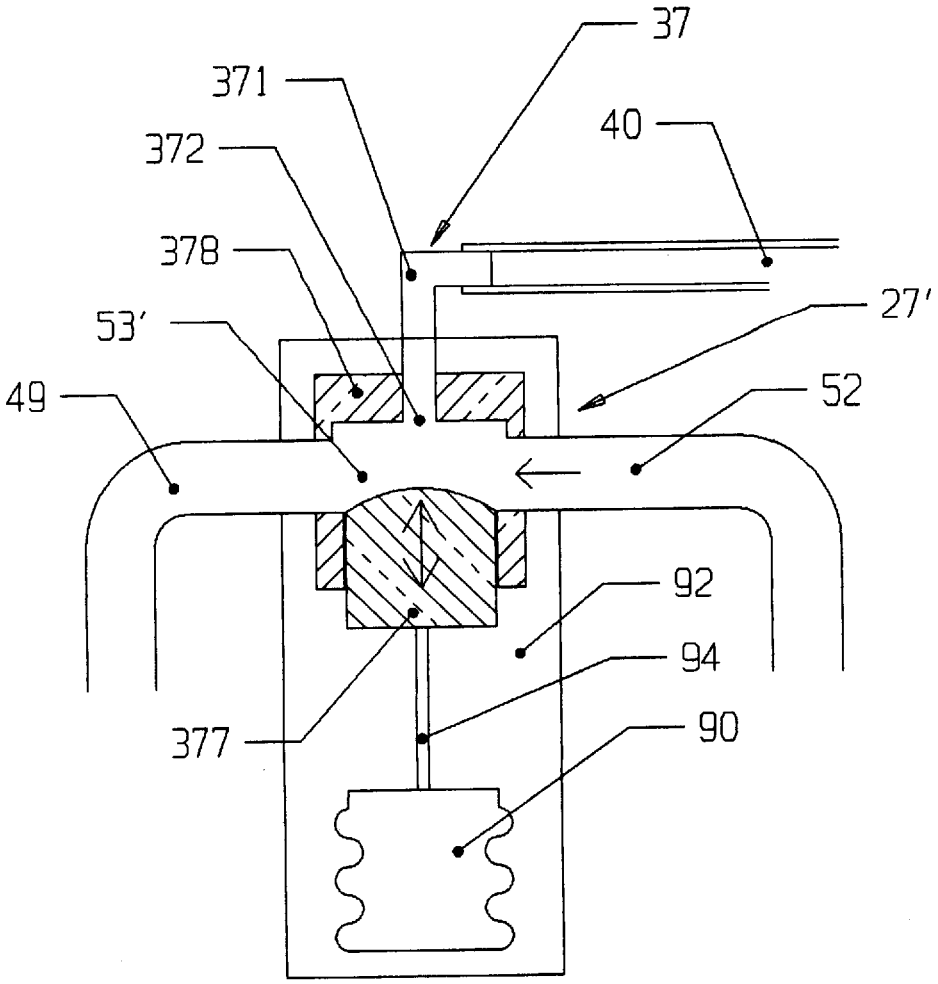
FIG. 7 shows a detail view of a fixed orifice/moveable restrictor internal vent assembly suitable for use in an auxiliary bore.

Description and Operation-FIG. 7

Another method of affecting the carburetor average reference pressure, and hence the average fuel flow, is by using an assembly as shown in FIG. 7. In this assembly, an auxiliary bore restrictor 377 is used to effectively reduce the cross sectional area of body cavity 53' axially close to fixed pressure sensing orifice 372. This orifice is fixed with its surface being positioned approximately parallel with the direction of gas flow. Conduits 53 and 52 connect to main bore locations with differing static pressures, preferably as shown in FIG. 2. Gas flow is induced in cavity 53' in the direction shown by the arrow. Conduit 371 connects orifice 372 to conduit 40, and hence the pressure sensed by orifice 372 is imposed on the carburetor and establishes its average reference pressure.

The principle of operation again involves Bernoulli's principle, namely a change in static presure in an orifice with its surface parallel to a gas flow as the gas flow speed changes. As restrictor 377 is moved toward orifice 372, the effective cross sectional area of cavity 53' is reduced, causing the gas flow velocity to increase. This affects a reduction in static pressure at orifice 372, and hence a reduction of carburetor average reference pressure and a reduction in fuel flow. Movement of restrictor 377 away from orifice 372 will have the opposite effect. It is of course important to the operation of this assembly that restrictor 377 lie axially near orifice 372. Preferably the cross sectional area of cavity 53' in this embodiment will be sufficiently large relative to the other auxiliary bore cross sectional areas to insure that the static pressure in orifice 372 will be approximately atmospheric with restrictor 377 fully withdrawn. This will maximize fuel flow through the carburetor with restrictor 377 fully withdrawn.

It is important to note that this assembly 37 is not a valve which performs a thermodynamically classed throttling operation. The operation of restrictor 377 allows isentropic gas flow through cavity 53'. One reason for this isentropic gas flow is the streamlined construction of restrictor 377 and cavity 53'. Another reason is that only a small restriction in cavity 53' is necessary to perform the required reduction of static pressure in orifice 372. This will insure isentropic gas flow and total pressure will be essentially constant throughout auxiliary bore 27'.

An example might help explain this isentropic flow in assembly 37. Carburetors such as assemblies 08 and 08' operate on a pressure differences across main fuel delivery system 30 of about 0.02 bar. In other words, gas flow is created in the area of main discharge orifice 303 sufficient to cause a reduction in static pressure which is 2% of an atmosphere. Since high speed fuel flow is proportional to the square root of the pressure existing across fuel delivery system 30, a 2% change in this pressure difference, or 0.0004 bar, would result in about a 1% change in fuel flow. Using this criterion, assembly 37 would be designed as follows. If high pressure orifice 48 is 6.35 mm (0.25 inches) in diameter, a satisfactory design for cavity 53' would have a diameter in the axial location of orifice 372 of 18.3 mm (0.72 inches). This would make the cross sectional area of cavity 53' with restrictor 377 fully withdrawn 8.4 times larger than the cross sectional area of orifice 48. If the static pressure difference between orifice 48 and orifice 50 is the above mentioned 0.02 bar, this would result in a pressure reduction in orifice 372 of only 0.0004 bar, resulting in only a 1% change in fuel flow. If a fuel delivery change of 10% was desired, the pressure existing in orifice 372 and hence the average reference pressure of the carburetor would need to be changed about 20%. In other words, a reduction in the 0.02 bar original fuel delivery pressure to 0.016 bar would cause about a 10% reduction in fuel flow. This would result if the restrictor were inserted into cavity 53' until the free area of cavity 53' were 2.23 times the area of orifice 48. The total gas flow through auxiliary bore 27' would be essentially unaffected by the movement of restrictor 377 to this degree, and hence the total pressure throughout auxiliary bore 27' will be essentially constant, and the flow is isentropic.

Also shown in FIG. 7 is a device to automatically position and regulate the moveable member of an internal vent assembly. An aneroid bellows 90 is connected to restrictor 377 by means of connecting member 94. A rigid platform 92 is used to maintain the relative positions of bellows 90 and body 378. Bellows 90 will expand with a decrease in relative air density, moving restrictor 377 toward the closed position. This will effect a reduction in static pressure at orifice 372, thereby reducing fuel flow through the carburetor. An increase in relative air density will have the opposite affect.

Summary, Ramification, and Scope

Accordingly, the reader will see that the Bernoulli principle internal carburetor vent can be used to regulate the flow of fuel through one or more carburetors with an easy external adjustment. It is not dependent on throttle position for its operation, but in fact is effective in uniformly regulating fuel flow over a wide range of throttle positions. It can be designed to easily isolate the carburetor reference pressure from pressure pulsations in the bore, or closely couple the same if desired. The carburetor can be inclined at severe angles, even with a horizontally mounted carburetor, without loss of fuel. This internal vent system can be applied to existing, externally vented carburetors easily and at low cost, and one carburetor modification can vent and regulate several carburetors. The positioning of the pressure sensing end of the vent in an auxiliary bore allows greater freedom in locating the main bore pressure sensing end, allows greater freedom in designing the overall venting system, and provides a system for easily modifying a conventional carburetor to use this system. It has been shown how this internal vent can be applied to wet diaphragm carburetors as well as float bowl carburetors.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A carburetor for providing a fuel/air mixture, said carburetor comprising:

an air induction tract with an air flow, said air induction tract containing a main bore with an air flow, said air induction tract having total pressure and static pressure, a fuel chamber, a fuel delivery means connecting said fuel chamber with said air induction tract, an average reference pressure which regulates fuel flow through said fuel delivery means, a pressure sensing means located in said air induction tract to establish said average, reference pressure, a surface effectively defining said pressure sensing means, a moveable member which is essentially ineffective in changing said air flow in said main bore and said total pressure in said air induction tract but which is effective in changing said induction tract air flow speed parallel to said surface, whereby pressure sensed by said pressure sensing means is changed, thus changing said average reference pressure and changing said fuel flow through said fuel delivery means.

2. The carburetor of claim 1 wherein said said pressure sensing means is located in said main bore.

3. The carburetor of claim 1 wherein said air induction tract has a main bore and an auxiliary bore with said pressure sensing means located in said auxiliary bore.

4. The carburetor of claim 1, wherein said moveable member moves said pressure sensing means thereby sensing different proportions of said total pressure and said static pressure.

5. The carburetor of claim 1 wherein said moveable member rotates said pressure sensing means in said air induction tract thereby sensing different proportions of said total pressure and said static pressure.

6. The carburetor of claim 1, wherein said moveable member changes the position of said pressure sensing means axially along said air induction tract thereby sensing different pressure.

7. The carburetor of claim 1, wherein said pressure sensing means with said defining surface is fixed and said moveable member changes said air flow speed parallel to said surface thereby changing said static pressure at said pressure sensing means.

8. The carburetor of claim 1, wherein said moveable member contains a conduit and said pressure sensing means is an orifice in said conduit.

9. The carburetor of claim 1, wherein said pressure sensing means is a fixed orifice with said defining surface and said moveable member is a variable restrictor positioned axially near said orifice, which restrictor by its movement changes said air flow speed parallel to said surface thereby changing pressure at said orifice.

10. The carburetor of claim 1, wherein said pressure sensing means is connected to more than one carburetor.

11. The carburetor of claim 1, wherein said movable member is automatically moved.

12. The carburetor of claim 1, wherein said moveable member is automatically moved in response to barometric pressure.

13. The carburetor of claim 1, wherein said moveable member is automatically moved in response to relative air density.

14. The carburetor of claim 1, wherein said moveable member is automatically moved in response to air temperature.

15. The carburetor of claim 1, wherein said moveable member is automatically moved in response to exhaust gas temperature.

16. The carburetor of claim 1, wherein said moveable member is manually moved.

17. The carburetor of claim 1, wherein said moveable member is moved by an aneroid bellows.

* * * * *